US006735149B2

(12) United States Patent
Pierot

(10) Patent No.: US 6,735,149 B2
(45) Date of Patent: May 11, 2004

(54) DEVICE FORMING A SNORKEL MOUTHPIECE OR DIVING REGULATOR

(75) Inventor: Bruno Pierot, L'Union (FR)

(73) Assignee: Amphicom, Montgiscard (FR)

( * ) Notice: Subject to any disclaimer, the term of this patent is extended or adjusted under 35 U.S.C. 154(b) by 0 days.

(21) Appl. No.: 10/203,960

(22) PCT Filed: Feb. 1, 2001

(86) PCT No.: PCT/FR01/00311

§ 371 (c)(1),
(2), (4) Date: Nov. 27, 2002

(87) PCT Pub. No.: WO01/62588

PCT Pub. Date: Aug. 30, 2001

(65) Prior Publication Data

US 2003/0151979 A1 Aug. 14, 2003

(30) Foreign Application Priority Data

Feb. 22, 2000 (FR) ..... 00 02187

(51) Int. Cl.[7] ..... H04B 11/00
(52) U.S. Cl. ..... 367/132
(58) Field of Search ..... 367/132, 131; 340/850; 181/127; 379/175; 381/151, 326

(56) References Cited

U.S. PATENT DOCUMENTS 5,579,284 A 11/1996 May ..... 367/132
5,706,251 A * 1/1998 May ..... 367/132

FOREIGN PATENT DOCUMENTS

| | | | | |
|---|---|---|---|---|
| CA | 2181052 | * | 7/2002 | ..... H04R/1/44 |
| EP | 0 487 599 | | 11/1994 | |
| FR | 2 650 987 | | 2/1991 | |

* cited by examiner

*Primary Examiner*—Daniel T. Pihulic
(74) *Attorney, Agent, or Firm*—Young & Thompson

(57) ABSTRACT

A device forming a mouthpiece for a snorkel or diving regulator, adapted to fit in the mouth of a diver or swimming and comprising a body provided with an air intake and extended by two lateral branched each provided with a bite tab, and at least one transducer buzzer positioned in one of the branches and comprising a piezoelectric membrane. Each transducer buzzer comprises a peripheral weight fixed to the periphery of the piezoelectric membrane, and elements for transmitting the vibrations of the membrane towards the teeth of the diver or swimmer. Furthermore, each transducer buzzer is positioned in the branch in such a way that the piezoelectric membrane is totally isolated from the external environment, and that the transmission elements form a contact interface with the teeth at the bite tab.

15 Claims, 2 Drawing Sheets

DEVICE FORMING A SNORKEL MOUTHPIECE OR DIVING REGULATOR

BACKGROUND OF THE INVENTION

The present invention relates to a device forming a mouthpiece for a snorkel or diving regulator for underwater communication, adapted to convert mechanical vibrations into electrical signals and vice versa.

DESCRIPTION OF THE RELATED ART

A mouthpiece of this kind, as currently known and described, particularly in EP-487,599, comprises a transducer buzzer positioned in a watertight way in said mouthpiece in the proximity of, or at least partially within, a bite tab, in such a way as to provide transmission of electrical signals to the inner ear through the jawbones.

However, the auditory quality of the sound reproduced, both in transmission and reception, by the existing mouthpieces designed according to this technology is considered to be insufficient at the present time.

SUMMARY OF THE INVENTION

The present invention is designed to overcome this problem and has the essential object of providing a mouthpiece for a snorkel or diving regulator which can improve the auditory quality of the reproduced sound, both in transmission and in reception.

Another object of the invention is to provide a convenient and reliable mouthpiece which is sufficiently robust to be durable over a period of time in operating conditions.

For this purpose, the invention aims to provide a device forming a mouthpiece for a snorkel or diving regulator, adapted to fit in the mouth of a diver or swimmer, and comprising:

- a body provided with an air intake and extended by two lateral branches each provided with a bite tab, and
- at least one transducer buzzer positioned in one of the branches and comprising a piezoelectric membrane.

According to the invention, this device is characterized in that each transducer buzzer

- comprises a peripheral weight fixed to the periphery of the piezoelectric membrane, and means for transmitting the vibrations of said membrane towards the teeth of the diver or swimmer, and
- is positioned in the branch in such a way that the piezoelectric membrane is totally isolated from the external environment, and that the transmission means form a contact interface with the teeth at the bite tab.

In the context of the invention, the terms "lateral", "lower" and "upper" are to be understood as referring to the body when it is fitted in the diver's mouth. Thus, "lateral" signifies that the bite tabs face each other at the lateral sides of the mouth.

Accordingly, the invention consists, in the first place, of the provision of a device comprising at least one transducer buzzer adapted to convert mechanical vibrations into electrical signals and vice versa, said transducer buzzer being positioned, on the one hand, in contact with the teeth of the diver or swimmer in order to transmit to the ear via the bones mechanical vibrations conveying the electrical signals received and, on the other hand, to receive the phonemes spoken by the diver.

The transducer buzzer is adapted, in a known way, to be connected to an electronic unit comprising a voltage source, an electrical amplifier, and a sound source or an underwater or wire transmitter and/or receiver, adapted to convert the electrical signals emitted by the transducer buzzer into signals propagated in water or in a wire, and vice versa. This underwater communication device operates as follows:

- For reception, the sound source or underwater or wire receiver converts the sounds into electrical signals suitable for being received by the transducer buzzer. This converts the electrical signals received into mechanical vibrations which are transmitted to the inner ear of the diver or swimmer via the teeth and the bones. The diver or swimmer then hears the messages sent by another diver, or the sounds sent by the sound source.
- For transmission, the phonemes spoken by the diver or swimmer generate mechanical vibrations of the teeth, which are received by the transducer buzzer which is in contact with the teeth. These mechanical vibrations are converted by the transducer buzzer into electrical signals and transmitted to the electronic unit.

Additionally, essentially, and according to the invention, each piezoelectric membrane is provided with a peripheral weight which helps to increase the inertia of the periphery of said membrane, and which, in practice, enables the intrinsic characteristics of this membrane to be modified in an advantageous way.

This is because, in practice, such a weight makes it possible to obtain a flatter spectrum over the whole audio band, and thus to enhance the quality of the reproduced sounds to a significant degree. Moreover, this weight forms a protective frame for the membrane which additionally helps to increase the rigidity of the membrane.

According to the invention, the term "weight" denotes a massive object fixed to the circumference of the piezoelectric membrane and in contact with said circumference only. If the piezoelectric membrane comprises a piezoelectric disk fixed to a flexible support disk, the weight can also consist of an increased thickness of said flexible support disk. It can also consist of an attached piece fixed to the periphery of the piezoelectric membrane.

However, if the piezoelectric membrane comprises a piezoelectric disk fixed to a flexible support disk, the peripheral weight advantageously forms the peripheral edge, fixed to said membrane, of a hollow isolating casing for the piezoelectric disk, which has a shape permitting the vibration of the piezoelectric membrane.

Such a casing allows the piezoelectric disk to be electrically isolated in a differential way by forming a metallic cage which isolates the disk from the external environment. Moreover, it also isolates the piezoelectric disk mechanically from the external environment, and, on the one hand, prevents the ingress of water, and, on the other hand, prevents any migration towards the mouth of the products forming this disk.

Additionally, and advantageously, the volume delimited by the casing and the piezoelectric membrane is filled with an incompressible fluid or gel which permits the vibration of said piezoelectric membrane.

This filling of the casing ensures that the piezoelectric membrane is mechanically protected against variations of pressure in the environment in the following circumstances:

- during the molding of the mouthpiece, in the course of which each transducer buzzer is overmolded with a material such as liquid silicone, and
- during diving.

Additionally, and advantageously, the volume delimited by the casing and the piezoelectric membrane is filled with gel, such as a silicone dielectric gel, and encloses an air bubble.

Such an air bubble makes it possible to decrease the constraints imposed by the gel on the deformations of the piezoelectric membrane, and thus promotes the vibration of the membrane.

Additionally, in order to produce this air bubble, the wall of the casing is advantageously pierced axially with an orifice blocked with a seal, and has a thickness such that said orifice delimits a volume enclosing said air bubble.

In an advantageous example, the casing delimits, together with the piezoelectric membrane, a volume of the order of 300 to 340 $mm^3$, the volume of the air bubble being approximately in the range from 10 to 30 $mm^3$.

Furthermore, for the sake of convenience, and advantageously, the casing has the general shape of a cap delimiting a chamber of domed shape.

In an advantageous embodiment, the transmission means comprise a stem fixed axially to the piezoelectric membrane and an interface bit mounted on said stem and having a shape adapted to be flush with one of the faces of the bite tab for contact with the teeth.

Additionally, and advantageously, the interface bit has a generally L-shaped face for interface with the teeth which is flush, on the one hand, with the lateral face of the branch, and, on the other hand, with one of the faces of the bite tab for contact with the teeth.

Because of the shape of this lateral bit, the contact between the bit and teeth can be lateral, and the user is therefore not obliged to clench his teeth, so that the risks of marking the bit and causing cramp in the user are diminished. This contact can also be optimal if it is sought by the user in certain situations by biting the bit between the two jawbones.

Additionally, in order to provide in a natural way a better lateral contact with the interface bit, each bite tab is advantageously generally T-shaped, forming, with the lateral face of the present corresponding branch, two areas of contact with the upper and lower teeth, each being generally U-shaped.

According to another advantageous characteristic of the invention, the device comprises two transducer buzzers, each encased in one of the lateral branches of the mouthpiece, said transducer buzzers being linked by a curved bar provided with means of fastening the casings of these transducer buzzers, and having a shape suitable for being encased in the lateral branches and body of said mouthpiece.

In this embodiment, as a result of the presence of the curved bar, it is possible to ensure precise positioning of the complete insert at the time of its overmolding, and consequently to produce a neat mouthpiece in a reproducible way.

Additionally, and advantageously, in order to ensure that the transducer buzzers are held in place, each casing has an intermediate peripheral annular groove formed in the outer face of said casing, the curved bar comprising two end sections in the form of arcs, each adapted to be housed and snap-fitted in the groove of one of the casings.

Additionally, an electrical cable is soldered in a conventional way to the two disks of each transducer buzzer, and, advantageously, each casing is pierced with a hole for the passage of said electrical cable, and the curved bar has a longitudinal guide groove for this electrical cable.

According to another advantageous characteristic, the mouthpiece comprises an electrical connection sleeve within which the electrical cable extends, enabling the mouthpiece to be connected simply and removably to an electronic unit.

BRIEF DESCRIPTION OF THE DRAWINGS

Other characteristics, objects and advantages of the invention will be made clear by the detailed description given below with reference to the attached drawings which represent by way of example, and without restrictive intent, a preferred embodiment of the invention. In these drawings.

DESCRIPTION OF THE PREFERRED EMBODIMENTS

Figure 1:
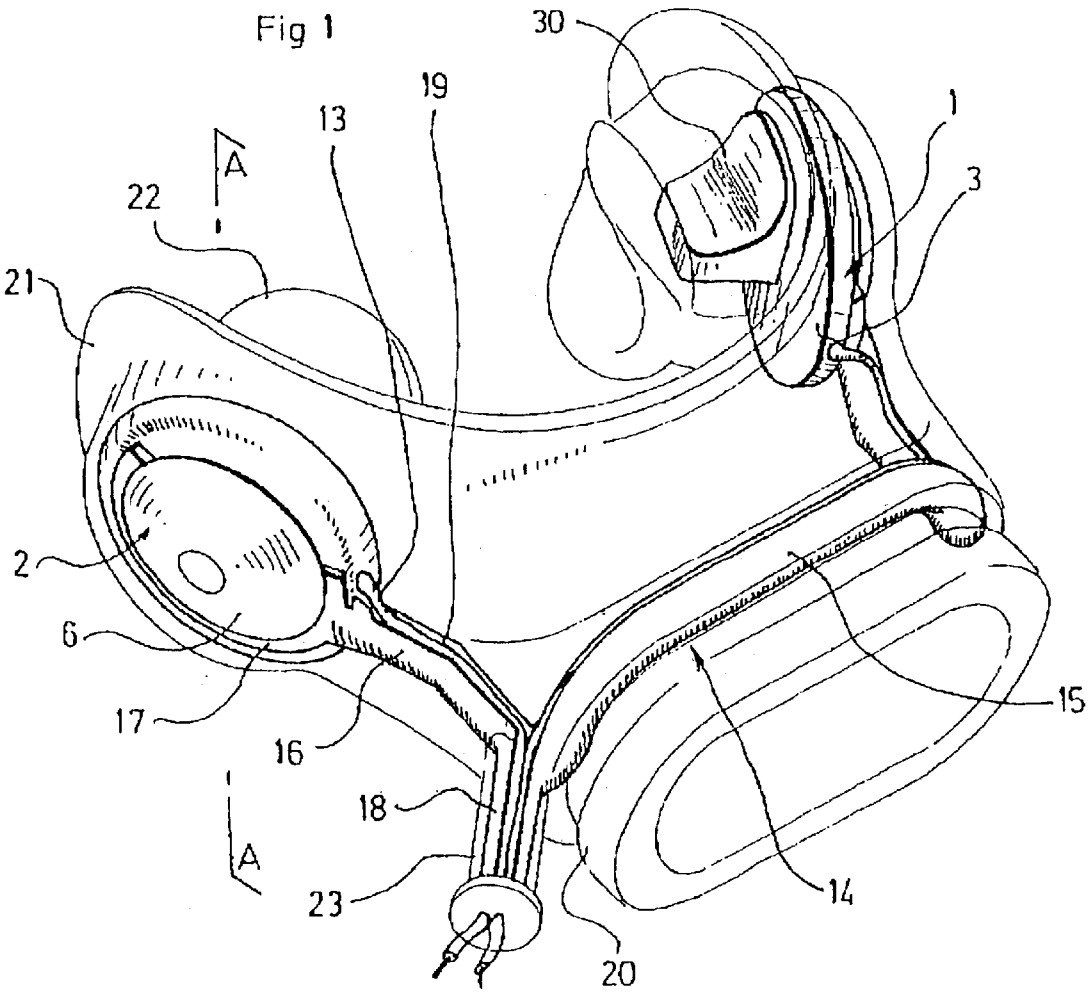
FIG. 1 is a perspective view of a mouthpiece for a snorkel or diving regulator according to the invention, in which the material of the mouthpiece is shown as if it were transparent.
Figure 2:
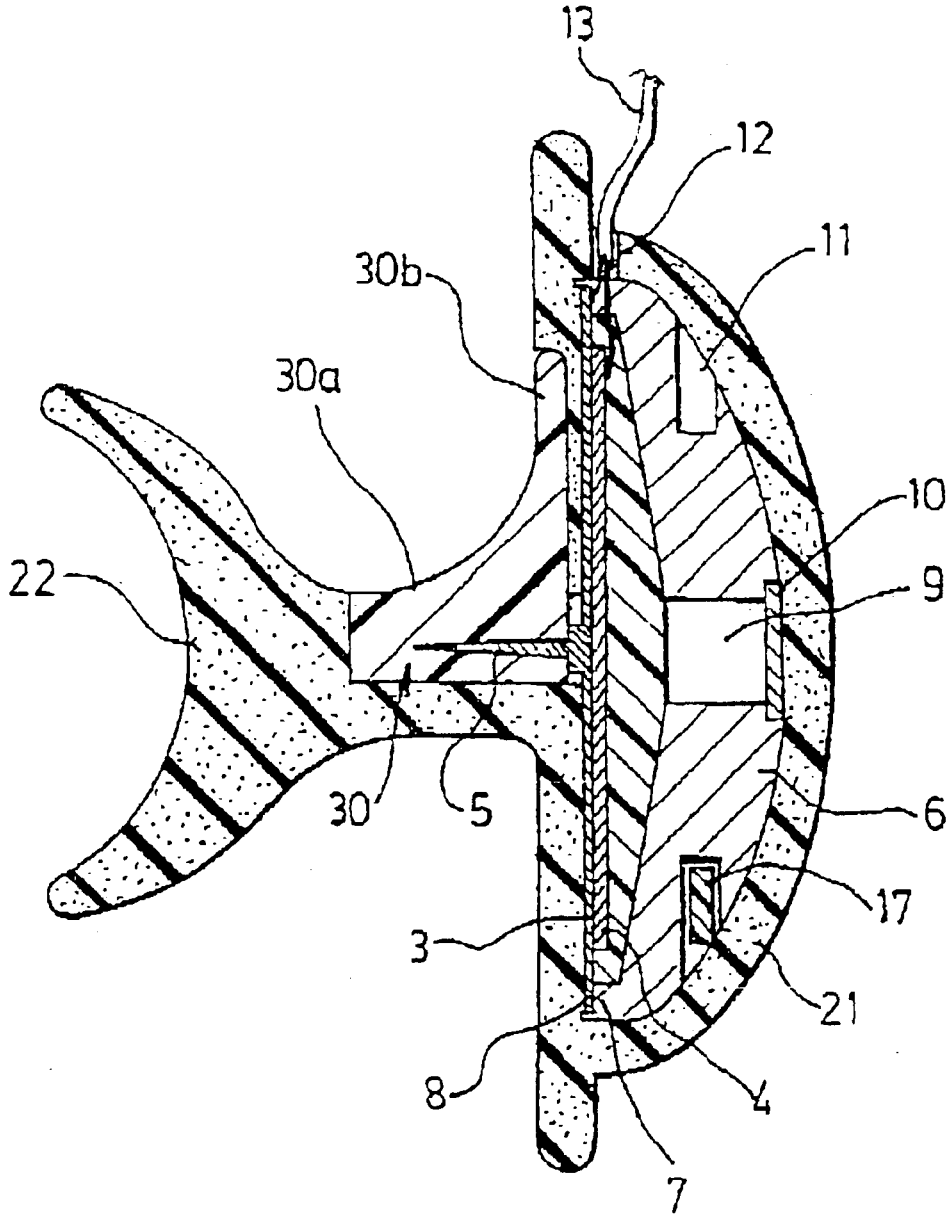
FIG. 2 is a section through this mouthpiece along a transverse plane A—A.

The mouthpiece for a snorkel or diving regulator shown in FIGS. 1 and 2 is designed to enable mechanical vibrations to be converted into electrical signals, or vice versa.

For this purpose, this mouthpiece comprises two transducer buzzers 1, 2, arranged, on the one hand, to have an interface in contact with the teeth of the diver to enable the mechanical vibrations conveying the received electrical signals to be transmitted via the bones to the ear, and, on the other hand, to receive the phonemes spoken by the diver in order to convert them into electrical signals.

As shown principally in FIG. 2, each of these transducer buzzers 1, 2 comprises, in the first place, a brass disk 3 on which is fixed a ceramic disk 4 whose diameter is slightly smaller than that of said brass disk 3. For example, the brass disk 3 can have a diameter of 20 mm and a thickness of 0.125 mm, and the ceramic disk 4 can have a diameter of 16 mm and a thickness of 0.11 mm.

Each of these transducer buzzers 1, 2 additionally comprises a metallic needle 5 soldered axially on the opposite face of the brass disk 3 from the ceramic disk 4, in such a way that it extends orthogonally with respect to the disk.

On this metallic needle 5 there is fitted an interface bit 30, which is generally L-shaped and has one wing 30*a*, parallel to the needle 5, fitted onto the latter, and another wing 30*b* extending parallel to the brass disk 3.

Each transducer buzzer also comprises a protective casing 6 for the ceramic disk 3, which is additionally designed to form a peripheral weight fixed to the periphery of said disk.

This casing 6 is in the form of a cap having a peripheral rim 7 with a shoulder 8 for bearing on and fixing to the periphery of the brass disk 3, said cap delimiting together with said disk a chamber filled with a gel such as a silicone dielectric, of the type marketed by Dow Corning under the brand name "527-2KG-Clair".

The wall of this casing 6 is also pierced axially with an orifice 9 provided with an outer countersink in which a seal 10 is fixed, said volume being adapted to enclose an air bubble.

For example, the volume of the gel-filled chamber is of the order of 320±10 $mm^3$, while the volume of the air bubble is from 10 to 30 $mm^3$.

Each casing 6 also comprises an annular peripheral groove 11 formed in its outer face.

Finally, each casing 6 comprises an orifice 12 formed in the proximity of the peripheral rim 7 of the casing, permitting the passage of a multi-strand silicone-sheathed cable 13 which is soldered to each of the two disks 3 and 4.

The two transducer buzzers 1, 2 described above are positioned with respect to each other, in the forming of the mouthpiece, by means of a curved bar 14 which also forms a guide for the cables 13.

As shown in FIG. 1, this curved bar 14 is made in the shape of a bridge 15 whose uprights are extended by two arms such as those indicated by 16, orthogonal to the plane of said bridge, each of said arms being additionally extended by a section 17 in the shape of an arc adapted to be housed and snap-fitted in the annular groove 11 of a casing 6.

Additionally, this curved bar 14 also comprises an oblique arm 18 extending outwards from the base of one of the uprights, on the opposite side from the arm 16 extending said upright.

Finally, each element of this curved bar 14 comprises a longitudinal groove 19 for housing and guiding the electrical cables 13.

The shapes of the transducer buzzers 1, 2, their positioning, and the way in which they are retained with respect to each other by means of the curved bar 14, make it possible to overmold them in a mold with a material such as liquid silicone, in such a way as to form a mouthpiece of generally conventional shape for a snorkel or diving regulator, the watertightness of each transducer buzzer 1, 2 being ensured by the adhesion of the silicone thereto.

As shown in FIG. 1, this mouthpiece comprises, in a conventional way, a tubular body 20 provided with an air intake, in the extension of which there extend two branches such as those indicated by 21 and in which the transducer buzzers 1, 2 and the curved bar 14 are entirely encased.

This mouthpiece also comprises two bite tabs such as those indicated by 22, molded on each of the branches 21 so that they face each other. Each of these two bite tabs 22 extends in a general T-shape from the lateral face of the corresponding branch 21, in such a way as to form, with this branch, two areas for contact with the teeth, namely an upper and a lower area, each area being generally U-shaped.

Additionally, these bite tabs 22 are molded in such a way that the lateral and upper faces 30*a*, 30*b* of the associated interface bits 30 are flush with the lateral faces of the branches 21 and the upper faces of said bite tabs, so that the contact between the teeth and the bit can be lateral or frontal.

Finally, the mouthpiece comprises a sleeve 23 overmolded on the oblique arm 18 of the curved bar 14 and forming a cable outlet in the form of a plug enabling the mouthpiece to be fitted simply and removably in a watertight way to an electronic unit (not shown) comprising, in a known way, a voltage source, an electrical amplifier, a sound source or an underwater transmitter and/or receiver for converting the electrical signals transmitted by the transducer buzzers 1, 2 into signals propagated in the water, and vice versa.

What is claimed is:

1. A device forming a mouthpiece for a snorkel or diving regulator, adapted to fit in the mouth of a diver or swimmer and comprising:

a body (20) provided with an air intake and extended by two lateral branches (21) each provided with a bite tab (22), and at least one transducer buzzer (1, 2) positioned in one of the branches (21) and comprising a piezoelectric membrane (3, 4), wherein each transducer buzzer (1, 2)

comprises a peripheral weight (6) fixed to the periphery of the piezoelectric membrane (3, 4), and means (5, 30) for transmitting the vibrations of said membrane towards teeth of the diver or swimmer, and is positioned in the branch (21) in such a way that the piezoelectric membrane (3, 4) is totally isolated from the external environment, and that the transmission means (5, 30) form a contact interface with the teeth at the bite tab (22).

2. A device as claimed in claim 1, wherein the transmission means comprise a stem (5) fixed axially on the piezoelectric membrane (3, 4) and an interface bit (30) fitted on said stem and having a shape adapted to be flush with one of the teeth contact faces of the bite tab (22).

3. A device as claimed in claim 2, wherein the interface bit (30) has a face for interfacing with the teeth which is generally L-shaped and is flush with the lateral face of the branch (21) and with one of the teeth contact faces of the bite tab (22).

4. A device as claimed in claim 3, wherein each bite tab (22) is generally T-shaped, and forms, together with the lateral face of the corresponding branch (21), two areas, one for contact with the upper teeth and one for contact with the lower teeth, each area being generally U-shaped.

5. A device as claimed in claim 1, in which the piezoelectric membrane comprises a piezoelectric disk (4) fixed to a flexible support disk (3), wherein the peripheral weight forms the peripheral edge, fixed to said membrane, of a hollow casing (6) which isolates the piezoelectric disk (4) and which has a suitable shape for permitting the vibrations of the piezoelectric membrane (3, 4).

6. A device as claimed in claim 5, wherein the volume delimited by the casing (6) and the piezoelectric membrane (3, 4) is filled with an incompressible fluid or gel which can permit the vibrations of said piezoelectric membrane.

7. A device as claimed in claim 6, wherein the volume delimited by the casing (6) and the piezoelectric membrane (3, 4) is filled with gel and encloses an air bubble.

8. A device as claimed in claim 7, wherein the wall of the casing is pierced axially by an orifice (9) blocked with a seal (10), and has a thickness such that said orifice delimits a volume enclosing the air bubble.

9. A device as claimed in claim 8, wherein the casing (6) delimits, together with the piezoelectric membrane (3, 4), a volume of the order of 300 to 340 $mm^3$, the volume of the air bubble being approximately in the range from 10 to 30 $mm^3$.

10. A device as claimed in claim 5, wherein the casing (6) has the general shape of a cap delimiting a chamber of domed shape.

11. A device as claimed in claim 5, wherein the device comprises two transducer buzzers (1, 2), each encased in one of the lateral branches (21) of the mouthpiece, said transducer buzzers being connected by a curved bar (14) which is provided with means (17) of attaching the casings (6) of these transducer buzzers (1, 2), and which has a shape such that it can be encased in the lateral branches (21) and the body (20) of said mouthpiece.

12. A device as claimed in claim 11, wherein each casing (6) comprises an intermediate annular peripheral groove (11) formed in the outer face of said casing, the curved bar (14) comprising two end sections in the form of arcs (17), each adapted to be housed and snap-fitted in the groove (11) of one of the casings (6).

13. A device as claimed in claim 11, in which an electrical cable (13) is soldered on to the two disks (3, 4) of the piezoelectric membrane, wherein each casing (6) is pierced with an orifice (12) for the passage of said electrical cable, the curved bar (14) having a longitudinal guide groove (19) for this electrical cable (13).

14. A device as claimed in claim 13, wherein the body (20) of the mouthpiece comprises an electrical connection sleeve (23) within which the electrical cable extends (13).

15. A device as claimed in claim 7, wherein the gel is a silicone dielectric gel.

* * * * *